US009676079B2

(12) United States Patent
Tropea

(10) Patent No.: US 9,676,079 B2
(45) Date of Patent: Jun. 13, 2017

(54) CLAMP

(71) Applicant: STANLEY BLACK & DECKER INC., New Britain, CT (US)

(72) Inventor: Gregory Tropea, Berlin, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 259 days.

(21) Appl. No.: 13/793,157

(22) Filed: Mar. 11, 2013

(65) Prior Publication Data

US 2014/0252711 A1 Sep. 11, 2014

(51) Int. Cl.

| | |
|---|---|
| ***B25B 1/00*** | (2006.01) |
| ***B25B 1/06*** | (2006.01) |
| ***B25B 1/02*** | (2006.01) |
| ***B25B 5/02*** | (2006.01) |
| ***B25B 5/06*** | (2006.01) |

(52) U.S. Cl.

CPC ..... *B25B 1/06* (2013.01); *B25B 1/02* (2013.01); *B25B 5/02* (2013.01); *B25B 5/068* (2013.01); *Y10T 29/49998* (2015.01)

(58) Field of Classification Search

CPC ..... B25B 5/068; B25B 5/163; B25B 27/0035; B25B 5/085

USPC ..... 269/90

See application file for complete search history.

(56) References Cited

U.S. PATENT DOCUMENTS

| | | | | |
|---|---|---|---|---|
| 2,990,738 | A | | 7/1961 | Zysset |
| 3,465,612 | A | | 9/1969 | Letwin et al. |
| RE26,884 | E | | 5/1970 | Hurst, Jr. et al. |
| 3,728,909 | A | | 4/1973 | Jespersen |
| 3,752,466 | A | | 8/1973 | Johnson |
| 3,759,504 | A | | 9/1973 | Hildebrand |
| 4,326,432 | A | | 4/1982 | Miller |
| 4,428,657 | A | | 1/1984 | Tezuka |
| 4,438,657 | A | | 3/1984 | Nobis |
| 4,698,048 | A | | 10/1987 | Rundle |
| D296,981 | S | | 8/1988 | Clark, Jr. |
| 4,938,091 | A | | 7/1990 | Waggoner et al. |
| 4,987,792 | A | | 1/1991 | Mueller et al. |
| 5,056,376 | A | | 10/1991 | Moroto et al. |
| 5,205,180 | A | | 4/1993 | Moroto et al. |
| 5,222,420 | A | * | 6/1993 | Sorensen et al. ..... 81/487 |
| 5,316,277 | A | | 5/1994 | Banks |
| 5,405,124 | A | * | 4/1995 | Mayer et al. ..... 269/45 |
| 5,676,357 | A | | 10/1997 | Horn |

(Continued)

OTHER PUBLICATIONS

Nikolaos Pastramas, European Search Report, Mar. 13, 2016, The Hague.

(Continued)

*Primary Examiner* — Joseph J Hail
*Assistant Examiner* — J. Stephen Taylor
(74) *Attorney, Agent, or Firm* — Gabriel A. Haboubi

(57) ABSTRACT

Embodiments generally relate to a clamp. In one embodiment, the clamp includes a bar, and a first jaw, movable along the bar and positioned on a first side of the bar. The clamp also includes a second jaw positioned on the bar on a second side of the bar, opposite the first side. The clamp also includes an actuator for moving the first jaw toward the second jaw for clamping one or more workpieces, and the actuator includes one or more drive plates operatively coupled to the bar when the first jaw is in a driving mode.

10 Claims, 11 Drawing Sheets

(56) References Cited

U.S. PATENT DOCUMENTS

| | | | | |
|---|---|---|---|---|
| 5,791,197 | A | 8/1998 | Rempinski et al. | |
| 5,845,535 | A | 12/1998 | Wakabayashi et al. | |
| 5,899,115 | A | 5/1999 | Kataumni et al. | |
| 5,927,150 | A | 7/1999 | Hirano et al. | |
| 6,230,579 | B1 | 5/2001 | Reasoner et al. | |
| 6,295,886 | B1 | 10/2001 | Russell | |
| 6,361,442 | B1 | 3/2002 | Dillenberger et al. | |
| 6,382,608 | B1 | 5/2002 | Michell | |
| 6,386,530 | B1 * | 5/2002 | Marks | 269/6 |
| 6,408,709 | B2 | 6/2002 | Kim | |
| 6,443,031 | B1 | 9/2002 | Kim | |
| 6,554,264 | B1 | 4/2003 | Alford | |
| 6,648,315 | B1 | 11/2003 | Lee | |
| 6,666,107 | B2 | 12/2003 | Kim | |
| 6,896,249 | B1 | 5/2005 | Ferrara | |
| 6,929,253 | B2 | 8/2005 | Marks | |
| 7,017,894 | B1 | 3/2006 | Lin | |
| 7,028,576 | B2 | 4/2006 | Zelman | |
| 7,090,209 | B1 | 8/2006 | Rowlay | |
| 7,114,410 | B2 | 10/2006 | Nagasawa | |
| 7,131,643 | B1 | 11/2006 | Sankey, II | |
| 7,293,480 | B2 | 11/2007 | Matsui et al. | |
| 7,328,782 | B2 | 2/2008 | DeJonge | |
| 7,641,183 | B2 | 1/2010 | Fuller et al. | |
| 7,651,078 | B2 * | 1/2010 | Geier et al. | 269/6 |
| 7,735,813 | B2 | 6/2010 | Geier et al. | |
| 7,784,774 | B2 | 8/2010 | Fuller et al. | |
| 7,896,322 | B2 * | 3/2011 | Geler et al. | 269/6 |
| 8,016,276 | B2 * | 9/2011 | Geier et al. | 269/6 |
| 8,240,647 | B2 | 8/2012 | Geier et al. | |
| 8,276,251 | B2 * | 10/2012 | Mitchell | 29/239 |
| 8,342,495 | B2 * | 1/2013 | Weissenborn | 269/101 |
| 2003/0234479 | A1 * | 12/2003 | Brass et al. | 269/97 |
| 2004/0140602 | A1 * | 7/2004 | Gerritsen et al. | 269/6 |
| 2004/0168537 | A1 | 9/2004 | Koontz | |
| 2006/0226588 | A1 | 10/2006 | Khachatoorian et al. | |
| 2007/0194510 | A1 | 8/2007 | Geler et al. | |
| 2009/0206534 | A1 * | 8/2009 | McCracken | 269/6 |
| 2010/0013136 | A1 * | 1/2010 | Strauss et al. | 269/90 |

OTHER PUBLICATIONS

Annex to the European Search Report on European Patent Application No. EP 14 15 8661, Mar. 8, 2016.

* cited by examiner

CLAMP

BACKGROUND

Clamps enable users to securely grip a work piece or multiple work pieces while performing a job on the work piece (e.g. sanding, finishing, cutting, gluing, etc.). Bench vise type clamps can be affixed to a work surface such as a table or a work bench. Bench vises often include a first jaw and a second jaw, positioned on a bar and operable to effectively clamp a work piece.

For example, to clamp the work piece a user rotates a lever arm that in turn incrementally advances the bar through an opening in the first jaw. This positions the first jaw adjacent to the second jaw to securely grip the work piece between the first jaw and the second jaw. After a user has completed a job on the work piece, the user typically reverses the rotation of the lever arm to incrementally move the bar in the opposite direction. This reverse rotation positions the first jaw away from the second jaw, so that the user can remove the work piece.

When starting a new project, to clamp the work piece the user again must rotate the lever arm to incrementally advance the bar through the opening in the first jaw, to position the first jaw next to the work piece and the second jaw. Using existing bench vices, repeatedly requires the user to take the time to incrementally advance the bar through the opening in the first jaw; in order to position the first jaw adjacent to the second jaw to clamp the work piece.

SUMMARY

Embodiments generally relate to a clamp. In one embodiment, the clamp includes a bar, and a first jaw movable along the bar and positioned on a first side of the bar. The clamp also includes a second jaw positioned on the bar on a second side of the bar, opposite the first side. The clamp also includes an actuator for moving the first jaw toward the second jaw for clamping one or more workpieces, and the actuator includes one or more drive plates operatively coupled to the bar when the first jaw is in a driving mode.

Some embodiments can also include a locking mechanism operatively coupled to the bar and which locks the first jaw with respect to the bar when the movable jaw housing is in a locking mode. In some embodiments, the clamp includes one or more lock plates operatively coupled to the bar when the first jaw is in a locking mode that locks the first jaw with respect to the bar. In some embodiments, the actuator is operable in a third mode that permits free movement of the first jaw across the bar. In an embodiment, the bar is disposed along a lateral axis, the first jaw travels along the lateral axis, and the actuator operates within a drive channel disposed in a direction that is parallel to the lateral axis. In some embodiments, the actuator includes a lever arm. In an embodiment, the drive plates are enclosed within a housing.

In one embodiment, a vise includes a movable jaw housing on a bar disposed along a lateral axis on a first side of the bar. The vise also includes a second jaw on the bar, on a second side of the bar, opposite the first side. The vise also includes an actuator for moving the movable jaw housing along the lateral axis toward the second jaw. The actuator operates within a drive channel disposed in a direction that is parallel to the lateral axis.

Some embodiments include a lever arm that is disposed within the drive channel. In some embodiments the actuator includes a lever arm that is disposed within the drive channel and moving the lever arm in a direction opposite the direction of movement of the movable jaw housing causes the movable jaw housing to move towards the second jaw. In an embodiment, the actuator includes one or more drive plates operatively coupled to the bar when the movable jaw housing is in a driving mode. In an embodiment, the locking mechanism is operatively coupled to the bar when the movable jaw housing is in a locking mode that locks the movable jaw housing with respect to the bar. In some embodiments one or more lock plates are operatively coupled to the bar to place the movable jaw housing in a second mode that locks the movable jaw housing with respect to the bar. In an embodiment, the actuator is operable in a third mode that permits free movement of the movable jaw housing across the bar. In an embodiment, the actuator includes one or more drive plates operatively coupled to the bar when the movable jaw housing is in a driving mode and wherein the drive plates are enclosed within a housing. In an embodiment, the actuator includes one or more drive plates operatively coupled to the bar such that the lock plates pivot around a pin workpiece.

In one embodiment, a method of making a clamp includes providing a movable jaw housing on a first side of a bar. The method also includes providing a second jaw positioned on the bar on a second side of the bar, opposite the first side. The method also includes activating an actuator to move the movable jaw housing toward the fixed jaw, and in a first mode the actuator locks the movable jaw housing with respect to the bar and the actuator is operable in a second mode that moves the movable jaw housing along the bar toward the fixed jaw.

With further regard to the method of making a clamp, in an embodiment, in a third mode the actuator is configured to permit free movement of the movable jaw housing across the bar. In an embodiment the method includes the step of activating the actuator includes a linear pumping motion. In an embodiment, the bar is disposed along a lateral axis, the movable jaw housing moves along the lateral axis, and actuator operates within a drive channel disposed in a direction that is parallel to the lateral axis.

These and other aspects, may provide one or more of the following advantages. The actuator may provide a high mechanical advantage when clamping a workpiece. The actuator may permit quick closing of the clamp.

DETAILED DESCRIPTION

Embodiments described herein provide a clamp or a bench vise for clamping work pieces. The clamp may be attached to a support workpiece (e.g. a work bench) while in use. In various embodiments, the clamp may include a bar, a first jaw (e.g. a movable jaw housing) positioned on the bar on a first side of the bar, and a second jaw (e.g., a fixed jaw) positioned on the bar on a second side of the bar, opposite the first side. In some embodiments, the clamp can include an actuator for moving the first jaw toward the second jaw for clamping the workpiece, wherein the actuator includes one or more drive plates that can be operatively coupled to the bar.

In some embodiments, the clamp includes a locking mechanism that can be operatively coupled to the bar that secures the first jaw so that the first jaw cannot move with respect to the bar. In some embodiments the locking mechanism is a lock plate that can be coupled to the bar.

The bar remains fixed while the first jaw may be moved towards the second jaw, for example, using a lever. In an example scenario, the clamp may have multiple modes of operation. For example, when the lever is in a neutral position, the clamp is in a locking mode, because the lock plates engage the bar in a manner that prevents the first jaw from moving towards the second jaw. In another example mode, when the lever is pushed down, the clamp is in a driving mode, because the drive plates engage the bar and move the first jaw toward the second jaw. In this example scenario, every time the lever is pushed down the first jaw moves incrementally forward. In another example mode, the lever is pushed up. In this position, the clamp is in a release mode because both the drive plates and lock plates are positioned in a manner that permit the first jaw to move freely with respect to the bar.

Figure 1A:
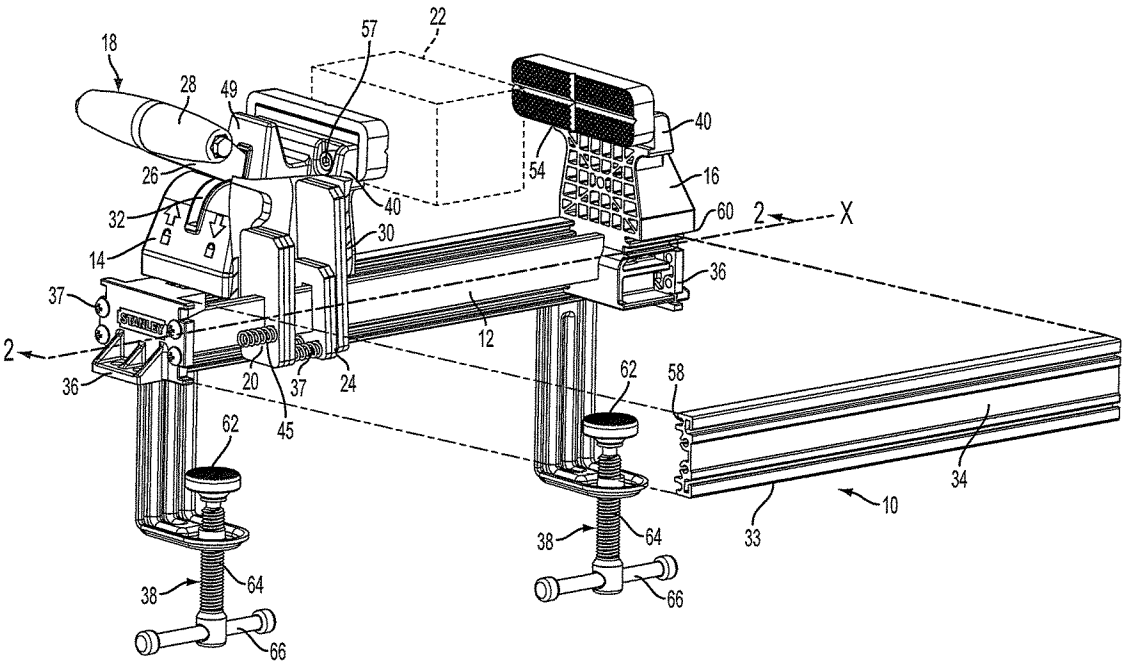
FIG. 1A illustrates an exploded perspective view of an example embodiment of a clamp in a release mode.
Figure 1B:
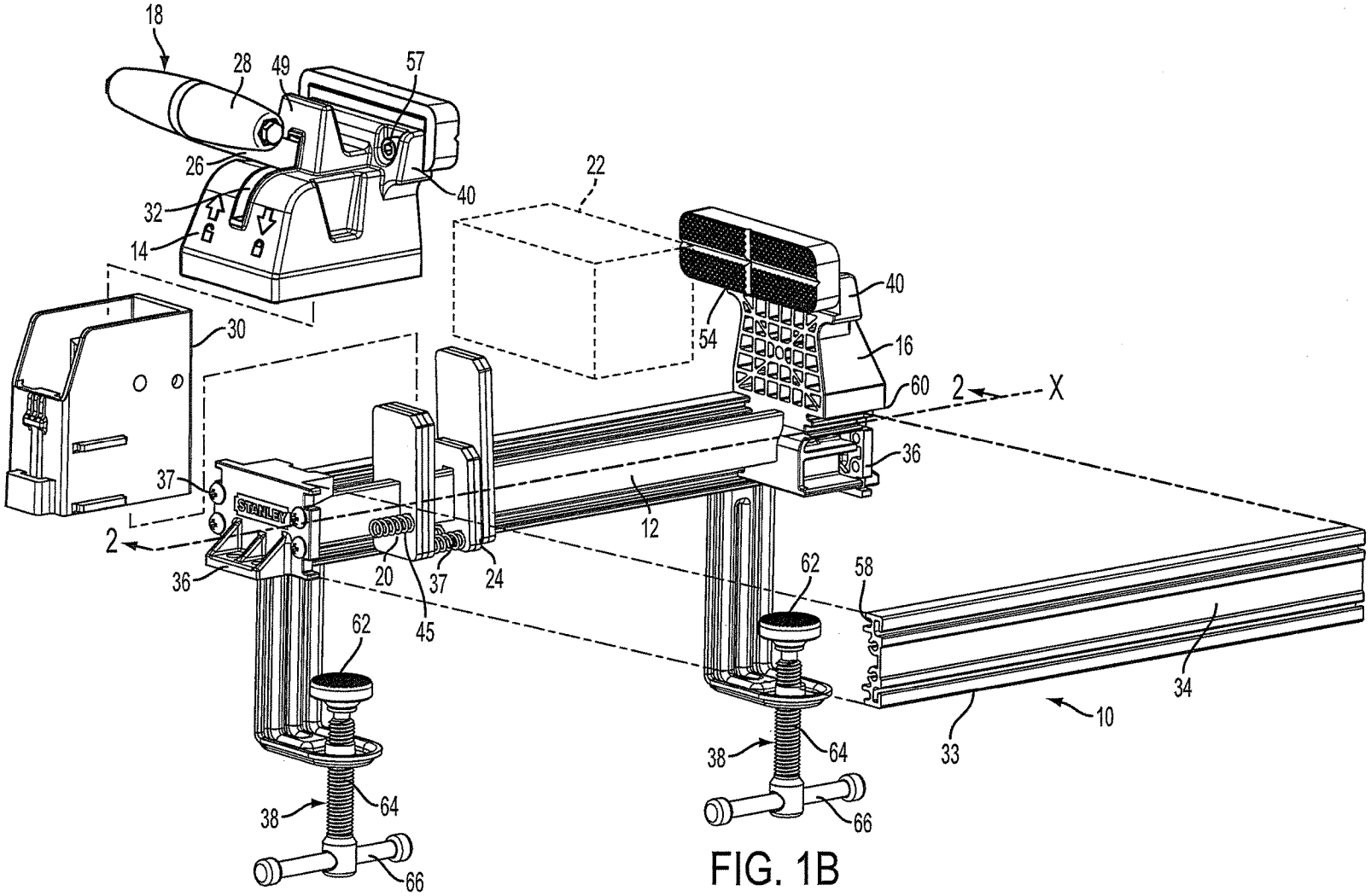
FIG. 1B illustrates an exploded perspective view of the clamp of FIG. 1A.
Figure 3A:
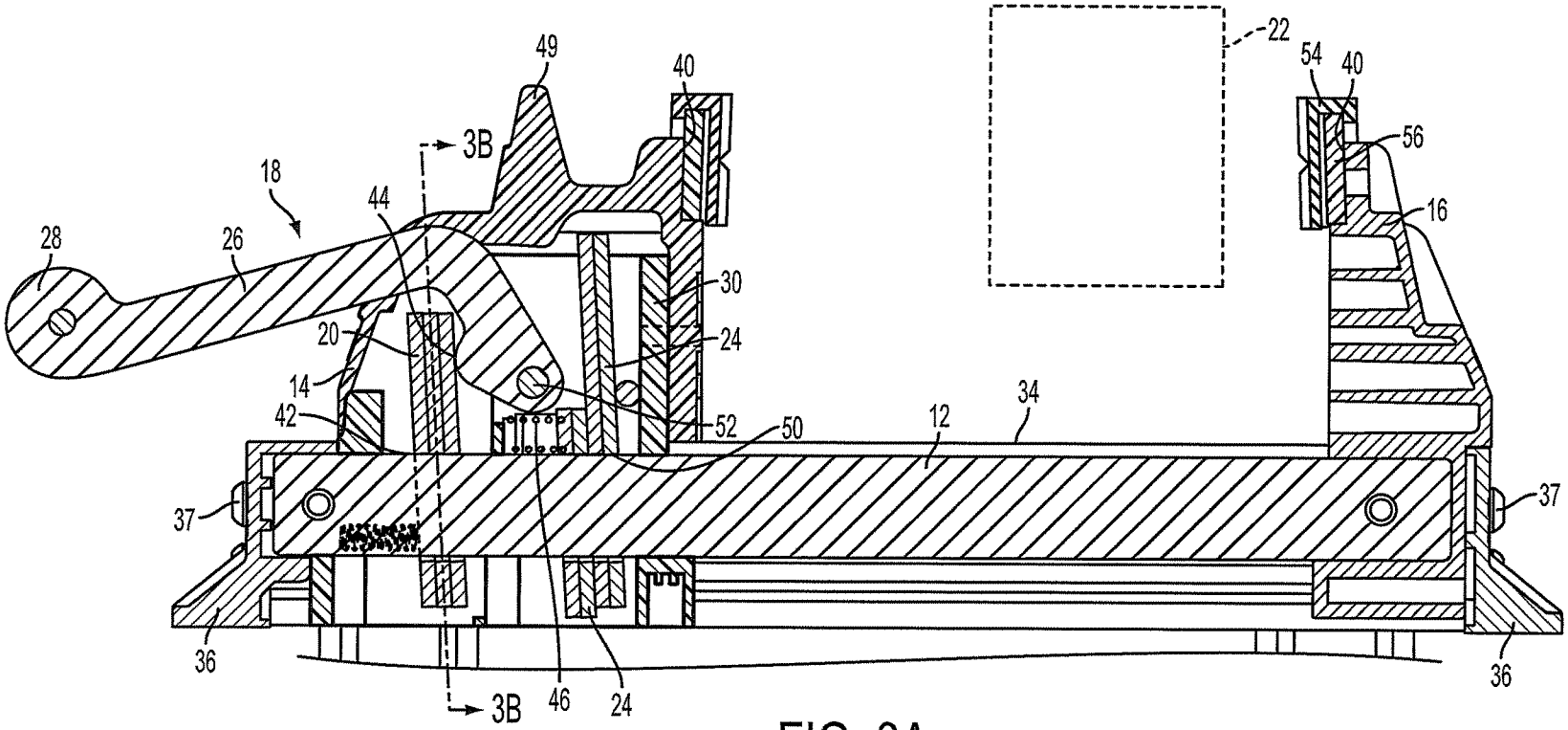
FIG. 3A illustrates a side cross-sectional view of the clamp of FIG. 1A in a driving mode.

Referring to FIGS. 1A, 1B, and 3A, in an example embodiment a bench vise or clamp 10 includes a bar 12. A first (or movable) jaw housing 14 and a second (or fixed) jaw 16 are attached to the bar 12. The clamp 10 includes an actuator 18 that has drive plates 20 operatively coupled to the bar 12 when the a lever 26 of the actuator 18 is pulled down (as shown in FIG. 3A), the movable jaw housing 14 moves along lateral axis X towards the second jaw 16 to clamp a workpiece 22 (e.g. a work piece or multiple work pieces).

Referring to FIGS. 1A and 1B, embodiments include lock plates 24 operatively coupled to the bar 12 when the movable jaw housing 14 is in a locking mode and also when the movable jaw housing 14 is in a driving mode. The actuator 18 may be placed in multiple modes of operation using a lever 26. In some embodiments, the lever 26 includes a t-handle 28 for a user to grip. Referring to FIG. 1B, a gear box or drive box 30, in part, encloses actuator 18, drive plates 20, and lock plates 24. When the clamp 10 is assembled, the movable jaw housing 14 is placed on top of the drive box 30 and may be secured using screws (not shown). In an example embodiment, a drive channel 32 is defined in the drive box 30 and the movable jaw housing 14. In some implementations, the lever 26 is disposed within the drive channel 32 so that it is operable to place the movable jaw housing 14 in multiple modes of operation. In an implementation, the drive channel 32 extends in the same direction as lateral axis X.

In an example embodiment, the movable jaw housing 14 and second jaw 16 are positioned on and may traverse across a frame that includes rails 34. The rails 34 are connected to end caps 36. The bar 12 may be disposed between the rails and fixed to the end caps 36 using pins (not shown). In an example embodiment, the clamp 10 may be attached to a support workpiece (not shown) using C-clamps 38 arranged on the rails 34. Non-limiting examples of a support workpiece include a work bench, desk, counter top, beam, and table. The movable jaw housing 14 and the fixed jaw 16 each include a clamping face 40. The clamping face 40 may be made of any material suitable to securely grip the workpiece 22 and not damage the workpiece 22.

Figure 2A:
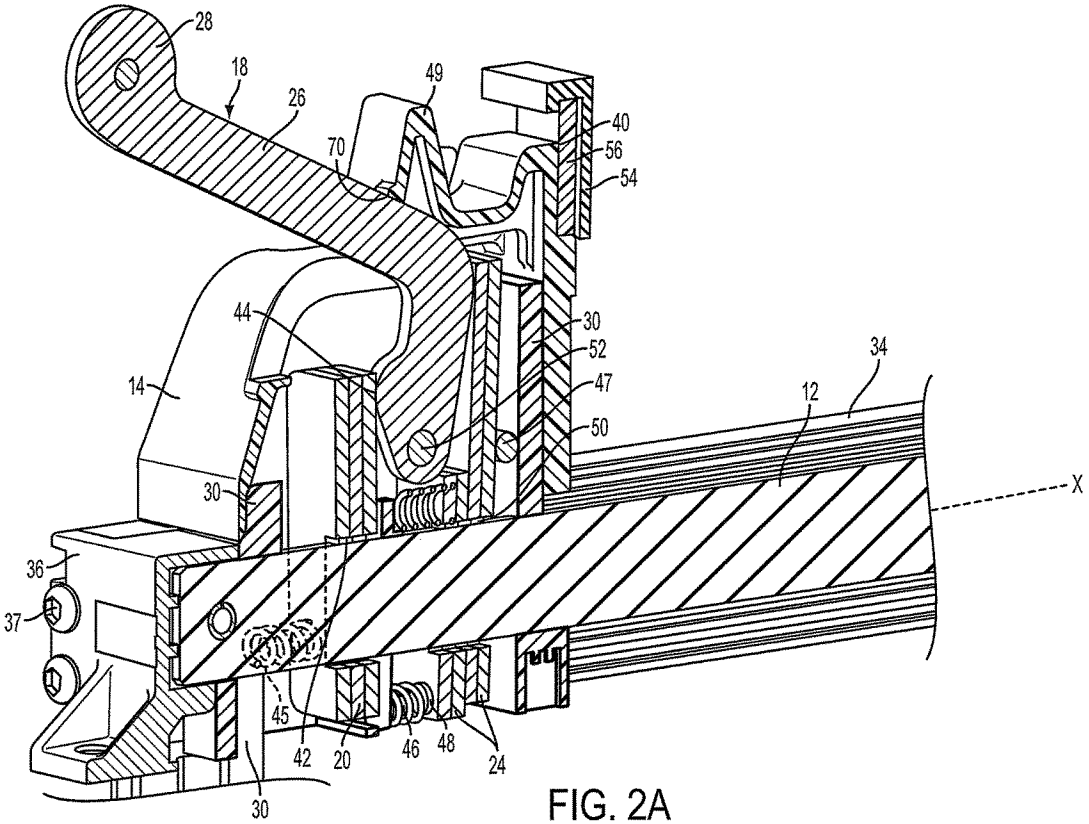
FIG. 2A illustrates an enlarged partial side cross-sectional view taken on line 2 of FIG. 1A.
Figure 2B:
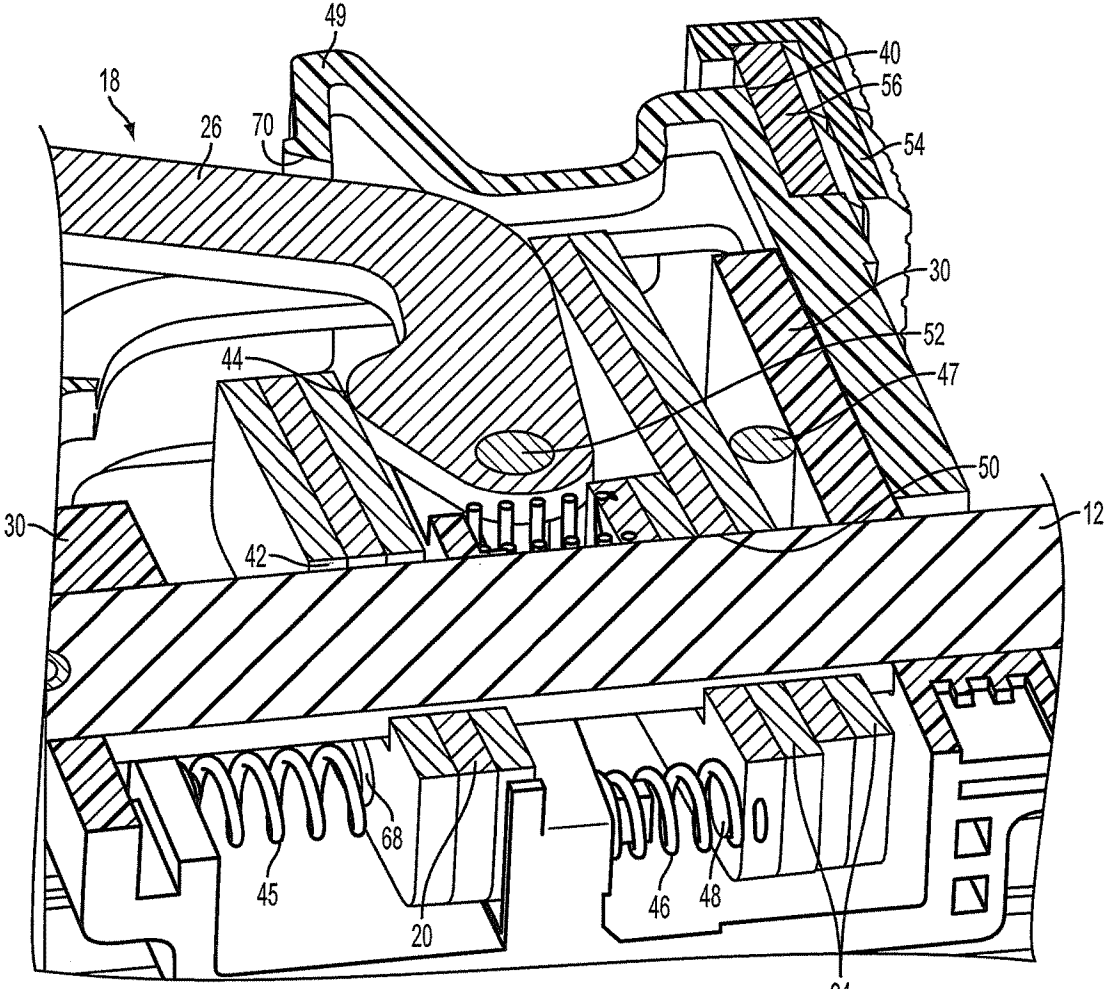
FIG. 2B illustrates an enlarged partial perspective view of the clamp of FIG. 1A.

Referring to FIGS. 2A and 2B, in an embodiment drive plates 20, have an open section designed to permit the bar 12 to pass through. Also, drive plates 20 include a drive edge 42 designed to frictionally engage with bar 12. A contact surface 44 of at least one of the drive plates 20 is positioned adjacent the distal (relative to the t-handle 28) portion of the lever 26 that is within the drive box 30. Referring to FIG. 2A, the clamp assembly is shown in a locking mode, in this position resilient elements, such as drive springs 45, bias the drive plates 20 so that they are vertical and not engaging the bar 12 Referring to FIG. 2B, a bottom portion of the drive plates 20 rest on a portion of the drive box 30. The described biasing of the drive plates 20 and the lock plates 24 cooperate to ensure that the lever 26 is maintained in the neutral position shown effectively placing the movable jaw housing 14 in the locking mode. The distal end portion of the lever 26 is balanced between the drive plates 20 and the lock plates 24.

Referring to FIGS. 2A and 2B, the drive springs 45 are attached to drive plates 20 around protrusions 68 formed in drive plates 20. The protrusions 68 may be of any size and shape to firmly secure and align the drive springs 45 between the drive plates 20 and an inner wall of the drive box 30. When the clamp 10 is in the locking mode (as shown in FIG. 2B) the drive springs 45 are positioned to bias drive plates 20 in a generally vertical position (as shown).

Figure 3B:
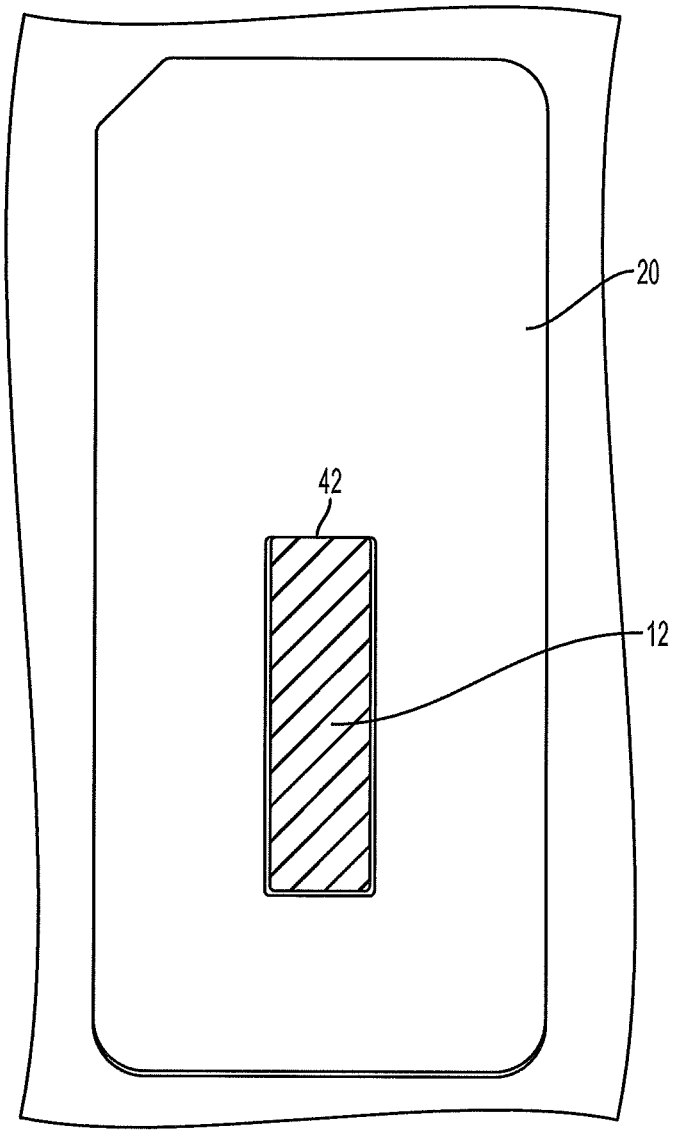
FIG. 3B illustrates a partial schematic cross-sectional view taken on line 3B-3B of FIG. 3A.

Referring to FIGS. 3A and 3B, the drive plates 20 are configured so that when the actuator 18 is moved into a driving mode, e.g. the lever 26 is pivoted counter-clockwise in the figure, it biases the drive plates 12 at the contact surface 44 (see FIG. 3A). Upon actuation, the drive plates 20 move counterclockwise the drive edge 42 of the drive plates 12 engages the bar 12 to pull the movable jaw housing 14 toward the second jaw 16. Because the contact surface 44 is at the distal end of the lever, a high mechanical advantage can be produced to move the movable jaw housing 14 towards the second jaw 16.

In some implementations, for example as illustrated in FIG. 2A, the drive plates 20 are generally rectangular shape in cross section. The drive plates 20 may be made in any shape or manner that permits firm contact with the bar 12 upon actuation of the lever 26. In an example implementation, a drive plate 20 has a height of about 58 mm, a width of about 26 mm and a thickness of about 1 mm. In an example implementation, the drive plates 20 are made of steel with a black oxide finish.

Referring to FIGS. 2A and 2B, in some implementations, two lock springs 46 are positioned on protrusions 48 between the drive box 30 and the lock plates 24. When clamp 10 is in a locking mode (as shown in FIG. 2B) lock springs 46 bias lock plates 24 in a counterclockwise direction so that securing surface 50 grips the bar 12 and prevents the movable jaw housing 14 from moving with respect to the bar 12. In an example implementation, the lock springs 46 can have an outside diameter of about 7 mm, a wire diameter of about 1 mm and may be made of Music Wire per ASTM A-228. In other implementations springs 46 may be replaced with any type of resilient elements.

Figure 4A:
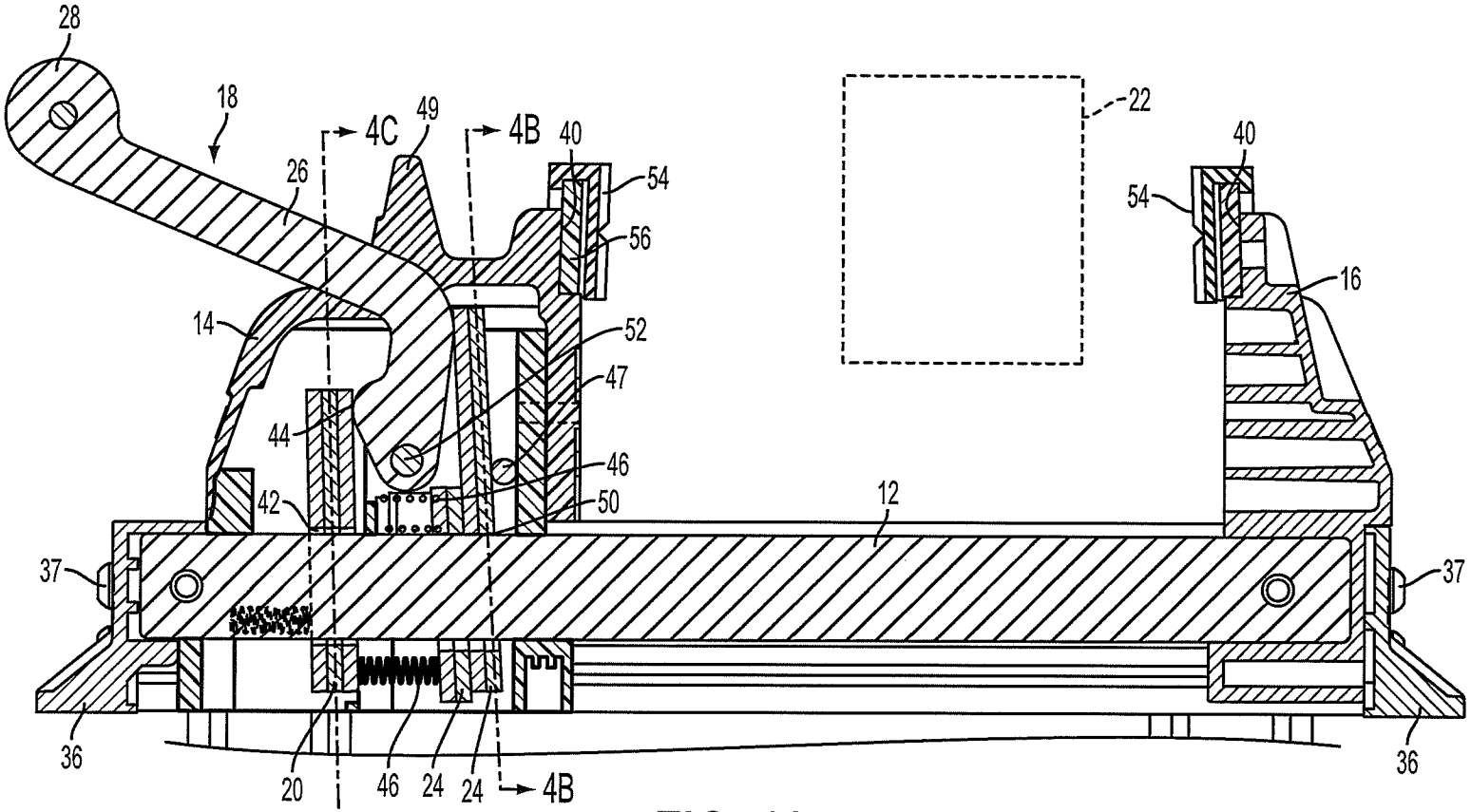
FIG. 4A illustrates a side cross-sectional view of the clamp of FIG. 1A in a locking mode.

Referring to FIGS. 1A, 1B, 2A, and 2B, in some embodiments, the lock plates 24, have an open section designed to permit the bar 12 to pass through and pivot about plate pin 47. The securing surface 50 is designed to frictionally engage with the bar 12 to stop any movement of the movable jaw housing 14 relative to the bar 12. In the locking mode, (shown in FIGS. 2B and 4A), the springs 46 bias the lock plates 24 so that they pivot about the plate pin 47 and the securing surface 50 is firmly engaged with the bar 12 in a manner that prevents any movement of the movable jaw housing 14 towards the second jaw 16. This effectively fixes the movable jaw housing 14 in a selected position along the bar 12.

Figure 5A:
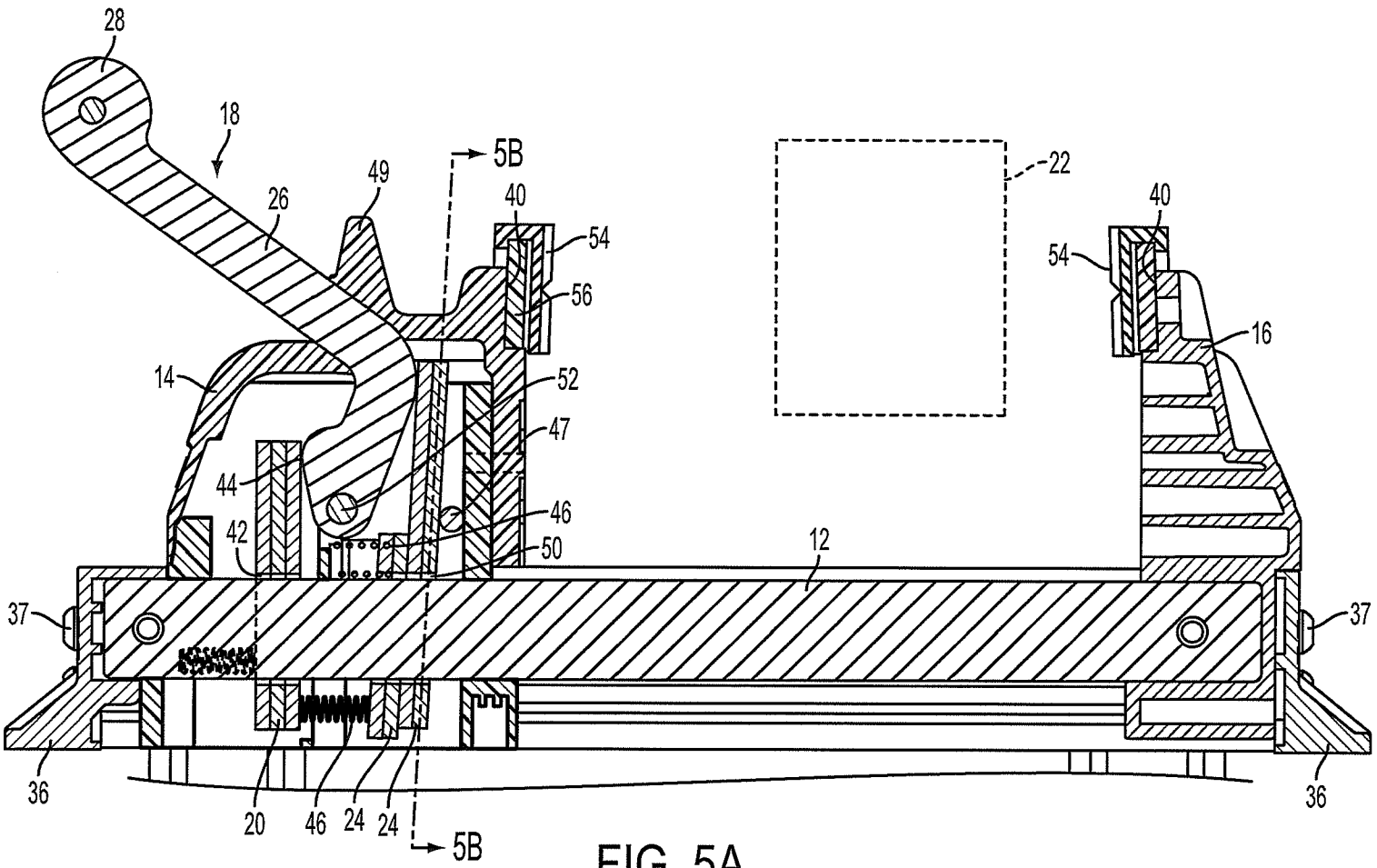
FIG. 5A illustrates a side cross-sectional view of the clamp of FIG. 1A in a release mode.

Referring to FIGS. 2A and 5A, the lever 26 is pushed into an upward position, thereby biasing the lock plates 24 to overcome the lock springs 46 and effectively position the lock plates 24 in a release mode. In this release mode, such that there is no contact between the securing surface 50 and the bar 12 and the lock plates 24 are generally in a counterclockwise position (as shown) and the lock plates 20 in a vertical position (as shown). When the clamp 10 is placed in this release mode, the movable jaw housing 14 can move freely towards or away the second (fixed) jaw 16.

Figure 4B:
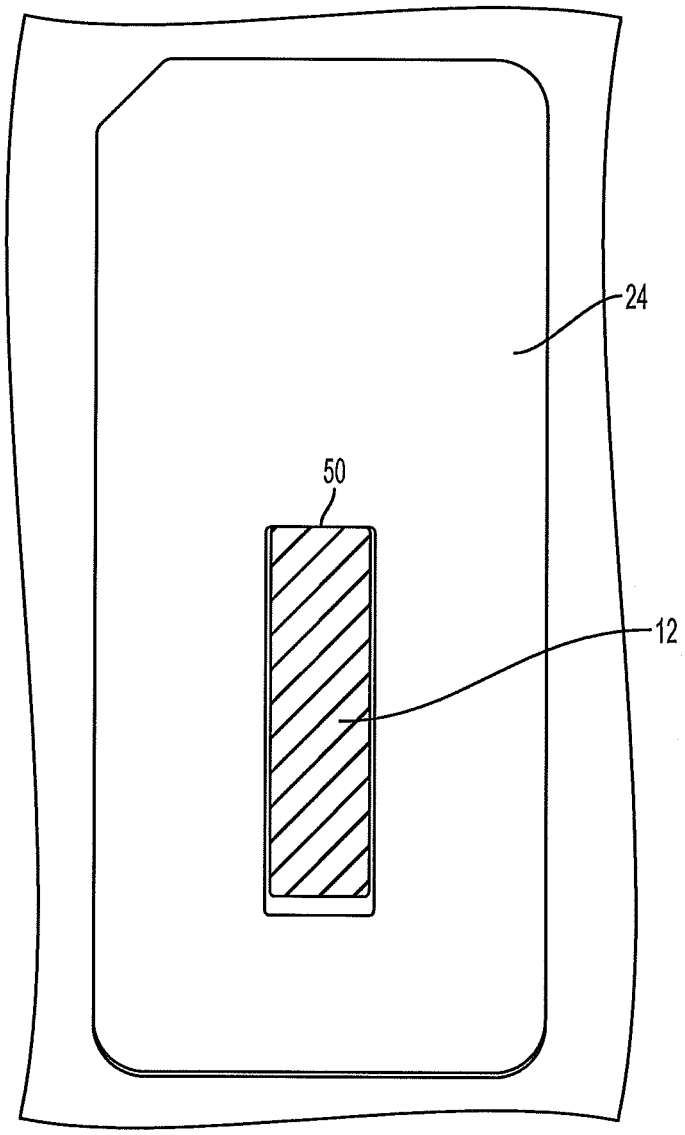
FIG. 4B illustrates a partial schematic cross-sectional view taken on line 4B-4B of FIG. 4A.

In some implementations, for example as illustrated in FIG. 4B, the lock plates 24 are rectangular shaped in cross section. The lock plates 24 may be made in any shape or manner that permits firm contact with the bar 12 upon actuation of the lever 26. In some implementations, a single lock plate 24 or locking mechanism that is engagable with the bar 12 may be used. In an example implementation, lock plates 24 are made of steel with a black oxide finish. In an example implementation, smaller (as illustrated) lock plate 24 has a height of about 41 mm, a width of about 24 mm and a thickness of about 3 mm. In an example implementation, larger (as illustrated to the right of smaller lock plates 24) lock plate 24 has a height of about 74 mm, a width of about 26 mm and a thickness of about 3 mm. Referring to FIG. 2A, in some implementations plate pin 47 is cylindrical in shape and pushes through holes (not shown) formed on walls of the drive box 30.

Referring to FIG. 1B, in some embodiments, the movable jaw housing 14 is generally sized and shaped to enclose a portion of the drive box 30. The movable jaw housing 14 is attached to drive box 30 using screws (not shown), however, other attachment means such as adhesive, interference fit, rib and recess could be used as well. The movable jaw housing 14 includes a support workpiece 49, sometimes referred to as a finger pull. In an example scenario, when applying force to push the lever 26 up against contact surface 70 and effectively place the clamp 10 into release mode, a user may push up on the t-handle 28 with one hand and for extra leverage place the other hand over the support workpiece 49. In some implementations movable jaw housing has a length (in the direction of lateral axis X) of about 74 mm, height of about 70 mm and width of about 58 mm and is made of nylon or glass filled nylon.

Referring to FIGS. 1A, 1B, and 2A, in an example embodiment, a distal portion of the lever 26 pivots within the drive box 30 about drive pin 52. The drive pin 52 is positioned in the drive box 30 by pushing the drive pin 52 through holes (not shown) formed on walls of the drive box 30, and then drive pin 52 is received by corresponding recesses in the movable jaw housing 14. The t-handle 28 may be attached to the proximal portion of the lever 26. In some embodiments, the lever 26 is actuated from the proximal portion, at the t-handle 28 point of attachment. For example, a user may actuate the lever 26 by gripping the t-handle 28 and pulling or pushing on the t-handle 28, thereby causing the lever 26 to pivot about the drive pin 52. In an example implementation the drive pin 52 has a length of about 34 mm, a diameter of about 6 mm, and is made of steel with a zinc coating.

Referring to FIGS. 1A, 1B, and 2A, the lever 26 passes through and is movable in the drive channel 32 defined in an upper portion of the movable jaw housing 14. The drive channel 32 acts as a guide by defining a passage for the lever 26, as the lever 26 moves through various modes of actuation.

In an example implementation, the lever 26 is generally rectangular in shape, and sized and shaped so that it can easily traverse through and within drive channel 32. In some implementations, the lever 26 is rectangular shaped in center portion and generally ends in an L-shape in proximal and distal portions. In an example implementation, the lever 26 has a thickness of about 12 mm, a length from end to end of about 95 mm, and the proximal and distal portions. In an example implementation, lever 26 is made of steel.

Referring to FIGS. 1A and 2A, in some embodiments pads 54 may be attached to the clamping faces 40. The pads 54 may be made of a material designed to firmly grip the workpiece 22. In some implementations, the pads 54 are made of a material that will not damage or mar the finish of the workpiece 22, for example rubber. Other non-limiting example materials for the pads 54 include felt and PVC.

Referring to FIG. 1A, in some embodiments, the clamping faces 40 may have recesses (not shown) formed on receiving the workpieces 56 that are positioned on the side of the clamping face and arranged to accept the pad 54. Corresponding ribs (not shown) may be formed on the pads 54, and sized and shaped to slide into recesses on the receiving workpieces 56. This arrangement permits the pads 54 to quickly be securely attached to the clamping faces 40 or interchanged when necessary, for example when the pads 54 are worn or soiled. In some implementations the receiving workpieces 56 may be attached to the clamping faces 40 using screws 57. In other implementations, the receiving workpieces 56 or recesses may be monolithically formed in the clamping faces 40 or attached using adhesive.

Referring to FIGS. 1A, 1B, and 2A, in some embodiments a drive box 30 is configured to permit the bar 12 to pass through the center of the drive box 30. The drive box 30 also partially encloses the drive plates 20, the lock plates 24, the lever 26, and the springs 46. Referring to FIG. 2A, the lock plates pivot about the plate pin 47. Referring to FIG. 1B, the drive box 30 has holes defined in its sides, holes are sized and shaped so that the plate pin 47 may be arranged in and secured to the drive box 30 between the lock plates 24. Upper and lower portions of the drive box 30 are open, to permit free movement of the lever 26, the drive plates 20, and the lock plates 24.

In some implementations, the drive box 30 is separate from the movable jaw housing 14, in other implementations, the drive box 30 may not be necessary and instead the movable jaw housing 14 may directly enclose the drive plates 20, the lock plates 24, the lever 26, and the springs 46. In a non-limiting example implementation the drive box 30 is made of nylon or glass filled nylon. In an example implementation drive box has a length of about 77 mm (along lateral axis X) a height of about 73 mm and a width/thickness of about 42 mm.

Referring to FIG. 1A, in an example embodiment the clamp 10 is a vise and has a frame. The frame 33 has rails 34 and end cap workpieces 36 are secured to ends of the rails 34. In some embodiments, bottom portion of the movable jaw housing 14 rests on top of the rails 34 and the movable jaw housing 14 is positioned so that upon actuation it slides on top of the rails 34 towards the second jaw 16. In other implementations, the end cap workpieces 36 are attached to the rails 34 using the screws 37. In an example implementation, the rails 34 and end the cap workpieces 36 may be molded as one monolithic piece.

In an example embodiment, the second jaw 16 includes attachment features, such as ribs and recess that interlock to secure the second jaw 16 to rails. The second jaw 16 also includes holes (not shown) in its housing to accommodate a pin (not shown) that passes through the second jaw 16 and the bar 12 and thereby secures distal end of the bar 12 within the second jaw 16. In some implementations, attachment features on the second jaw 16 cooperate with corresponding features on the rails 34 to ensure that the second jaw 16 remains fixed. In other implementations, the second jaw 16 may be configured to move and slide on top of the rails 34, similar to the movable jaw housing 14.

Referring again to FIG. 1A, the C-clamps 38 may be used to securely attach the clamp 10 to any work surface (not shown). The C-clamps 38 include clips (not shown) that are designed to interlock with outer portion of the rails 34 to effectively fix the C-clamps 38 to frame. The C-clamps 38 have the securing pads 62 that can be tightened against a work surface by rotating screw the threads 64 using the handle pins 66.

Referring to FIGS. 3A and 3B, a user can actuate the clamp 10 by pressing downward (or counterclockwise with respect to the page) on the t-handle 28 causing the drive plates 20 to pivot generally in a counterclockwise direction and grip the bar 12. This effectively places the movable jaw housing 14 into a driving mode, so that it moves towards the second jaw 16. In an example scenario, a user may need to secure the workpiece 22 to perform an operation on the workpiece 22, for example such as sanding, cutting, finishing, carving, gluing, etc. In an example step, the user places the workpiece 22 between the movable jaw housing movable jaw housing 14 and the second jaw 16. Next, the user activates the actuator 18 by pushing downward on the t-handle 28 (in a counterclockwise direction with respect to the page), the lever 26 thereby pivots causing the drive plates 20 to engage against the bar 12 and effectively propel the movable jaw housing 14 towards the second jaw 16. Referring to FIG. 3B, as illustrated, during actuation the drive edge 42 of the drive plates 20 is in contact with the bar 12.

In an example scenario, the user may quickly close the clamp 10 using a pumping motion on the t-handle 28. When the t-handle 28 is pushed down by user, the distance between the t-handle 28 and the point of the drive edge 42, permits the user to exert a high mechanical advantage to grip the workpiece 22 between the clamping faces of the movable jaw housing 14 and the second jaw 16.

Figure 4C:
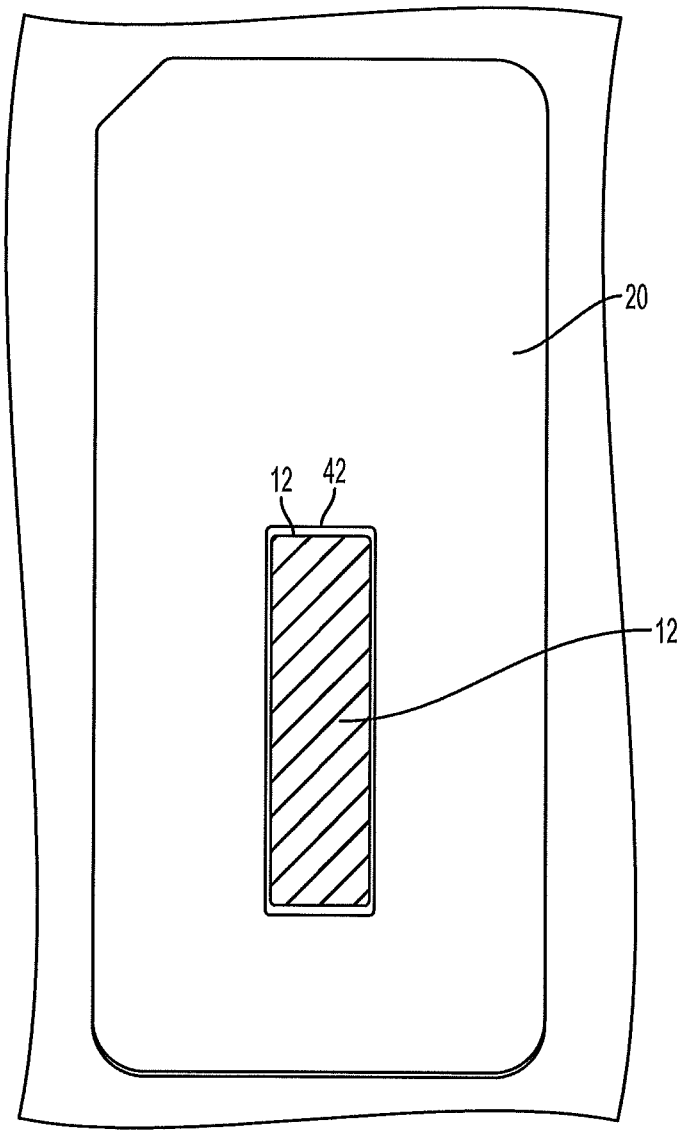
FIG. 4C illustrates a partial schematic cross-sectional view taken on line 4C-4C of FIG. 4A.

Referring to FIGS. 2B, 4A, 4B, and 4C, the clamp 10 is shown in a locking mode. In an example scenario, when the user stops pushing down on the t-handle 28, the drive springs 45 bias the drive plates 20 and the lock springs 26 bias the lock plates 24, and thereby the lever 26 to the neutral position. In the neutral position, the t-handle 28 has moved upward (or clockwise from actuated position with respect to page). Referring to FIG. 4B, with the lever 26 in the neutral position, the movable jaw housing 14 is in the locking mode, the contact surface 50 of the lock plate 24 firmly engages the bar 12 and effectively prevents the movable jaw housing 14 from moving with respect to the bar 12. Referring to FIG. 4C, in the locking mode the drive surface 42 of the drive plates 20 does not engage the bar 12. Once the user has clamped the workpiece 22 between the clamping faces 40 of the movable jaw housing 14 and the second jaw 16, the user may simply let go of the t-handle 28 and the movable jaw housing 14 will not move with respect to the bar 12. So for example, if the user stopped actuation (e.g. to take a break) thereby causing the clamp 10 to move to the locking mode, and then returned and inadvertently bumped the movable jaw housing 14 housing, it would not move with respect to the bar 12.

Figure 5B:
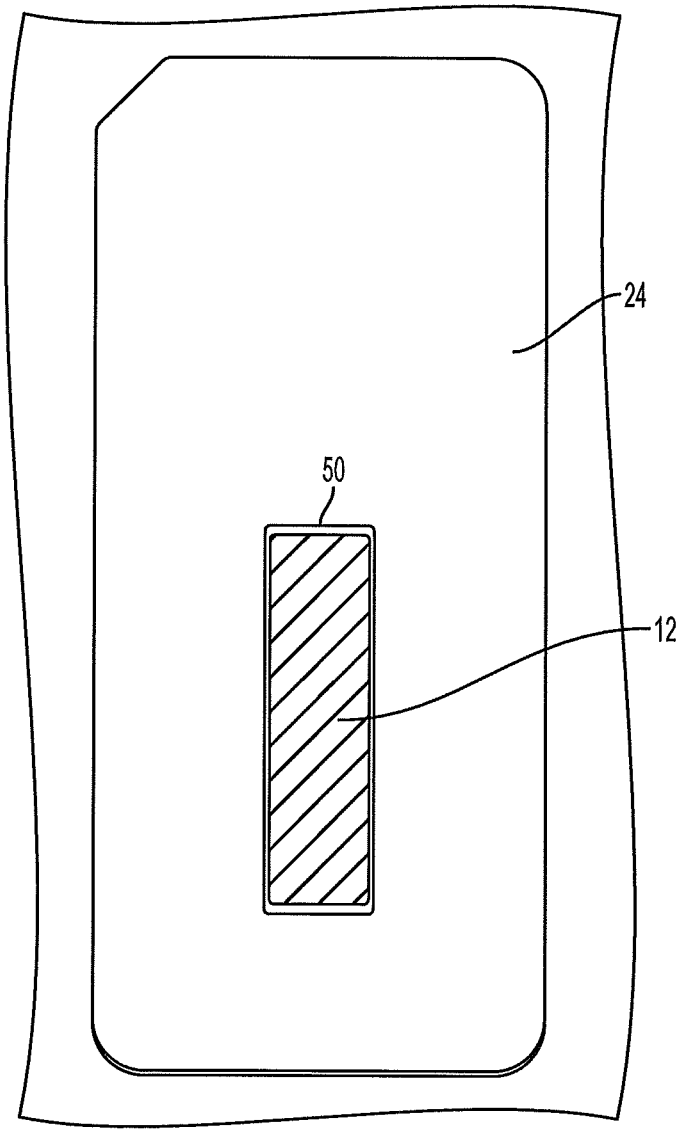
FIG. 5B illustrates a partial schematic cross-sectional view of taken line 5B-5B of FIG. 5A.

Referring to FIGS. 2A, 5A, and 5B the clamp 10 is shown in a release mode. The user may place the clamp 10 into release mode by moving the t-handle 28 upward (clockwise with respect to page) until the lever 26 hits the contact surface 70. In the release mode, both the drive plates 20 and the lock plates 24 are vertical (as shown). In this position the drive plates 20 and the lock plates 24 are perpendicular to lateral axis X. As illustrated in this position, there is a gap between the drive plates 20, the lock plates 24, and the bar 12. Accordingly, the movable jaw housing 14 can freely move across the bar 12. Release mode permits for very fast clamping, because a user can freely move the movable jaw housing 14 to a position proximate the workpiece 22 along the bar 12 in one swift motion, and then start actuating clamping mode to exert a mechanical advantage to firmly secure the workpiece 22 between clamping faces 40 of the movable jaw housing 14 and the second jaw 16.

In the foregoing description and in the accompanying drawings, specific terminology and drawing symbols have been set forth to provide a thorough understanding of the disclosed embodiments. In some instances, the terminology and symbols may imply specific details that are not required to practice those embodiments.

Various modifications and changes may be made to the embodiments presented herein without departing from the broader spirit and scope of the disclosure. For example, features or aspects of any of the embodiments may be applied, at least where practicable, in combination with any other of the embodiments or in place of counterpart features or aspects thereof. Accordingly, the specification and drawings are to be regarded in an illustrative rather than a restrictive sense.

What is claimed is:

1. A clamp comprising:

a bar disposed along a lateral axis;

a first jaw, movable along the bar along the lateral axis, and positioned on a first side of the bar;

a second jaw positioned on the bar on a second side of the bar, opposite the first side;

an actuator including one or more drive plates, one or more lock plates, and a lever arm, the lever arm movable between a) a release mode where the actuator positions the drive plates and the lock plates relative to the bar to permit free movement of the first jaw across the bar, b) a drive mode where the drive plates are operatively coupled to the bar and engage the bar and move the first jaw toward the second jaw, and c) a lock mode where the lock plates are operatively coupled to the bar to prevent movement of the first jaw with respect to the bar; and a c-clamp configured to selectively secure the clamp to a support workpiece separate from the one or more workpieces;

wherein the lever arm is configured to be moved along a drive channel in a direction generally transverse to the lateral axis to cause said movement of the actuator moves the first jaw toward the second jaw along the lateral axis;

wherein movement of the lever arm into the release mode comprises movement of the lever arm in a direction away from the bar; and wherein the actuator is biased into the lock mode.

2. The clamp of claim 1, wherein the drive plates are enclosed within a housing.

3. A vise comprising:

a movable jaw housing on a bar disposed along a lateral axis on a first side of the bar;

a second jaw on the bar, on a second side of the bar, opposite the first side;

an actuator including a lever arm for moving the movable jaw housing along the lateral axis toward the second jaw, wherein the lever arm is configured to be moved along a drive channel in a direction generally transverse to the lateral axis among a plurality of modes, including a) a release mode where the actuator disengages the bar to permit free movement of the first jaw across the bar, b) a drive mode where the actuator engages the bar and moves the first jaw toward the second jaw, and c) a lock mode where the actuator engages the bar to prevent movement of the first jaw with respect to the bar; and a c-clamp configured to selectively secure the clamp to a support workpiece separate from the one or more workpieces;

wherein movement of the lever arm into the release mode comprises movement of the lever arm in a direction away from the bar; and wherein the actuator is biased into the lock mode.

4. The vise of claim 3, wherein moving the lever arm in a direction opposite the direction of movement of the movable jaw housing causes the movable jaw housing to move towards the second jaw.

5. The vise of claim 3, wherein the actuator includes one or more drive plates operatively coupled to the bar when the movable jaw housing is moved from the lock mode into the drive mode.

6. The vise of claim 3, wherein the actuator includes one or more lock plates, wherein in the lock mode the one or more lock plates are operatively coupled to the bar to lock the movable jaw housing with respect to the bar.

7. The vise of claim 3, wherein the actuator includes one or more drive plates operatively coupled to the bar when the movable jaw housing is in the drive mode and wherein the drive plates are enclosed within a housing.

8. The vise of claim 3, wherein the actuator includes one or more drive plates, operatively coupled to the bar such that the lock plates pivot around a pin workpiece.

9. The vise of claim 3, wherein the lever arm is moved from the lock mode to the drive mode through a generally linear pumping motion.

10. A clamp comprising:

a bar defining a lateral axis;

a movable jaw housing disposed on the bar and movable along the lateral axis including to a first end of the bar;

a second jaw on a second end of the bar, opposite the first end; and an actuator for moving the movable jaw housing along the lateral axis toward the second jaw, the actuator comprising a lever arm;

wherein the lever arm is configured to be moved along a drive channel in a direction generally transverse to the lateral axis among a plurality of modes, including a) a release mode where the actuator disengages the bar to permit free movement of the first jaw across the bar, b) a drive mode where the actuator engages the bar and moves the first jaw toward the second jaw, and c) a lock mode where the actuator engages the bar to prevent movement of the first jaw with respect to the bar;

wherein movement of the lever arm into the release mode comprises movement of the lever arm from the lock mode in a direction away from the bar;

wherein movement of the lever arm into the drive mode comprises movement of the lever arm from the lock mode in a direction towards the bar; and wherein the lever arm is biased from the drive mode into the lock mode such that driving the first jaw towards the second jaw via movement of the lever arm comprises pumping the lever arm from the lock mode into the drive mode.

* * * * *